US005802990A

United States Patent [19]

Lin

[11] Patent Number: 5,802,990

[45] Date of Patent: Sep. 8, 1998

[54] COMPUTER RACK

[76] Inventor: Chin-Chih Lin, 2F, No. 160, Shih Ta Road, Taipei, Taiwan

[21] Appl. No.: 866,344

[22] Filed: May 30, 1997

[51] Int. Cl.[6] ..... A47B 3/06

[52] U.S. Cl. ..... 108/157.1; 108/180; 108/192

[58] Field of Search ..... 108/157.1, 153.1, 108/50.01, 43, 180, 192, 193, 56.3, 901, 902

[56] References Cited

U.S. PATENT DOCUMENTS

| | | | |
|---|---|---|---|
| 4,316,419 | 2/1982 | Cupido | 108/902 X |
| 4,418,627 | 12/1983 | Baker | 108/180 X |
| 4,469,231 | 9/1984 | Hehn | 108/180 X |
| 5,158,187 | 10/1992 | Taub | 108/192 X |
| 5,438,938 | 8/1995 | Meeker et al. | 108/180 X |
| 5,706,741 | 1/1998 | Thorp et al. | 108/153.1 X |
| 5,709,158 | 1/1998 | Wareheim | 108/180 X |

*Primary Examiner*—Jose V. Chen
*Attorney, Agent, or Firm*—Bacon & Thomas

[57] ABSTRACT

A computer rack for placement on a desk surface including a top plate and two side plates. The top plate has a plate surface with a top side and a bottom side. At least one corner of the top side is sunken to form a plate ring with a central ring hole. The bottom side of the plate surface has criss-cross partition ribs. The two side plates face each other and are fixedly provided at both sides of the top plate. A plate post is disposed at a front end and a rear end of each side plate, each plate post having a curved hole at an upper end for matching the ring holes, and a post leg at a lower end for contacting the desk surface. Each side plate further has criss-cross plate ribs at an inner wall thereof. Support shafts of computer peripheral devices may be inserted into the ring holes and the curved holes for positioning purposes and for enhancing connection between the computer rack and computer peripheral devices. Two opposing slide tracks are provided at the inner walls of the two side plates for mounting a keyboard rack.

6 Claims, 2 Drawing Sheets

COMPUTER RACK

BACKGROUND OF THE INVENTION (a) Field of the Invention

The present invention relates generally to a computer rack, and more particularly to an improved computer rack for placement on a desk surface, in which the computer rack may be connected to computer peripheral devices.

(b) Description of the Prior Art

At present, computer monitors are generally placed on desk surfaces of computer desks or on computer frames. In both cases, the monitor is fixedly provided to facilitate operation. But in cities where space is limited, such computer desks for placement of monitors and keyboards occupy space. There has been developed computer racks for mounting on a desk surface of a standard height for placement of the monitor and keyboard.

Existing computer racks are largely made of metal plates bent to a desirable shape, which is not very pleasing in appearance. Besides, it is not possible to fully utilize the structure of the computer racks, for instance, coupling a copy holder or telephone holder to the rack so as to reduce the number of articles to be placed on the rack surface. In addition, since the keyboard is stored at a lower part of the rack, it has to be taken out for use when needed, which is very inconvenient.

SUMMARY OF THE INVENTION

A primary object of the present invention is to provide an improved computer rack for placement on a desk surface, in which the computer rack has enhanced structural strength.

Another object of the present invention is to provide an improved computer rack for placement on a desk surface, which may be connected to computer peripheral devices.

A further object of the present invention is to provide an improved computer rack for placement on a desk surface, in which the computer rack may be injection molded.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
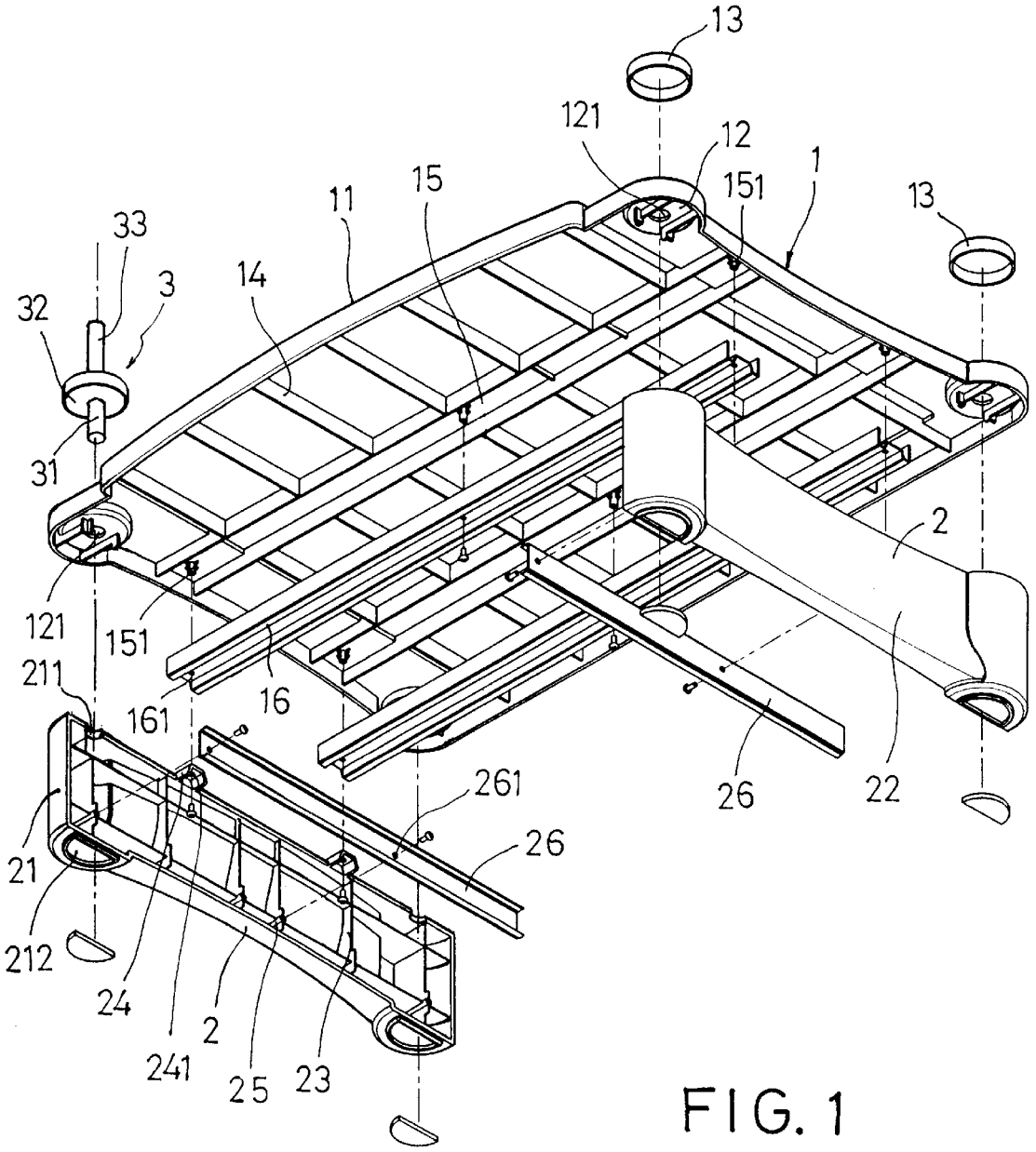
FIG. 1 is a schematic elevational exploded view of the Computer rack of the present invention.
Figure 2:
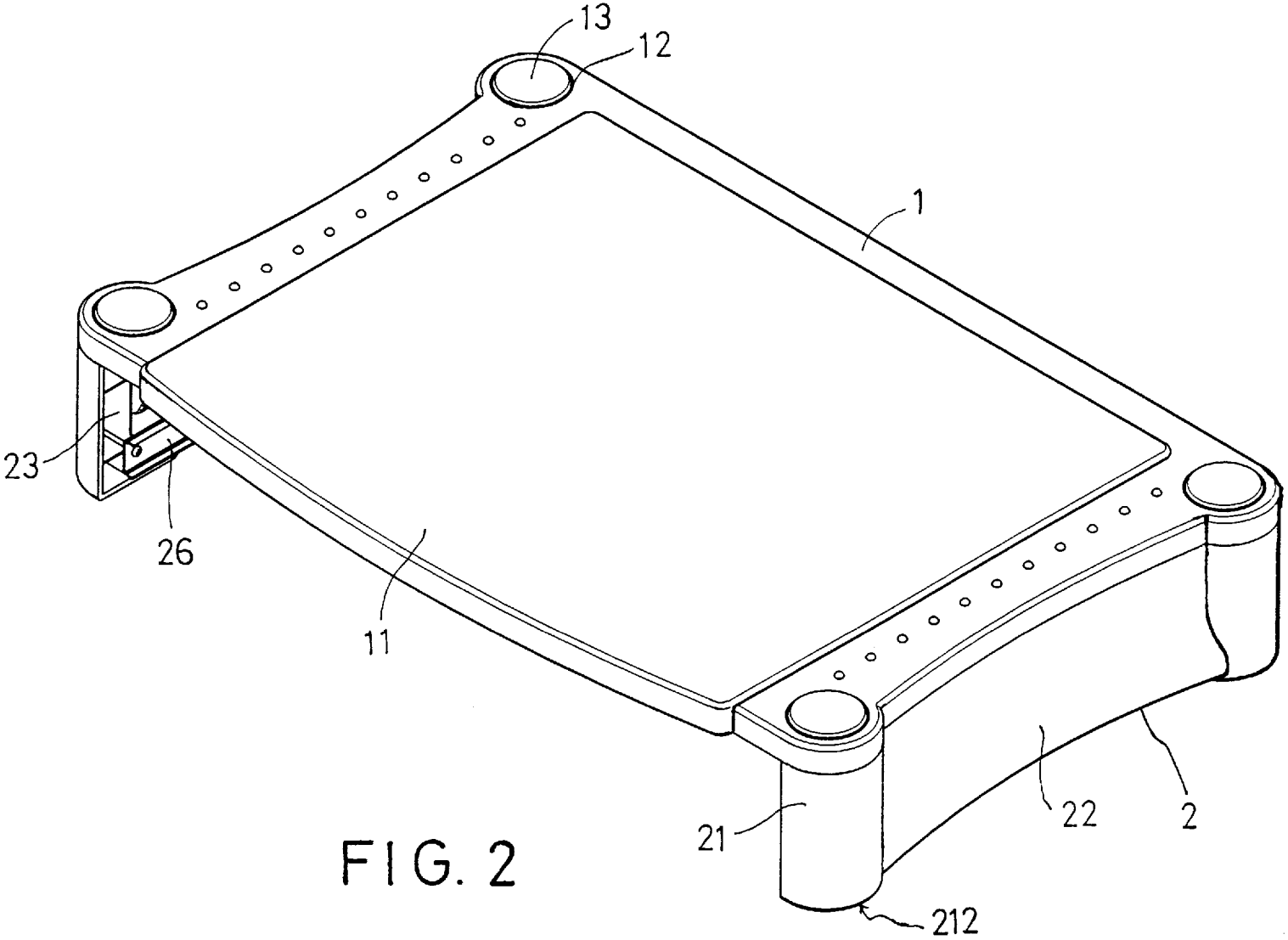
FIG. 2 is an assembled perspective view of the present invention.

With reference to the drawings, the computer rack of the present invention essentially comprises a top plate 1 and two side plates 2.

The top plate 1 includes a plate surface 11 at an upper side thereof for placement of a monitor. At least one corner and/or each corner of the plate surface 11 is sunken to form a plate ring 12 with a ring hole 121 at its center. In order to conceal the plate rings 12 at the corners so as to appeal to the eye and prevent accumulation of dust particles, each plate ring 12 may be fitted with a ring cap 13. In addition, a bottom side of the plate surface 11 is provided with a plurality of partition ribs 14 in a crisscross arrangement for supporting the top plate 1. At the same time, in order to enhance the rigidity of the top plate 11, two or more plate grooves 15 may be provided at suitable positions in a transverse direction. A plurality of lock posts 151 are provided in each plate groove 15 at its two ends or its middle. The lock posts 151 engage corresponding through holes 161 of an elongated reinforcing element 16 provided to reinforce the strength of the top plate and prolong the use life of the computer rack.

The two side plates 2 are respectively disposed at both sides of a bottom side of the top plate 1 in an opposing arrangement. To facilitate description of the side plates 2 herein, only the structure of one of the side plates 2 is described in detail. The width of the side plate 2 is the same as that of the top plate 1. A curved plate post 21 is disposed at a front end and a rear end of the side plate 2 for matching the plate rings 12. An upper end thereof is provided with a semi-circular, curved hole 211 for matching the ring hole 121, while a bottom side thereof is provided with a post leg 212 for contacting a desk surface. In addition, the side plate 2 has a curved profile 22 at an outer side thereof for enhancing the overall appearance of the computer rack after assembly. An inner wall of the side plate 2 is also provide with criss-cross plate ribs 23 for enhancing the structural strength of the side plate 2. Additionally, at a top rim of the side plate 2 corresponding to the through holes 161 are provided with lugs 24 with respective lug holes 241 for passage of screws through the lug holes 241, and the through holes 161 to lock in the lock posts 151, so that the side plate 2 and the reinforcing element 16 may be secured on either side of the top plate 1, thus accomplishing the initial assembly of the computer rack of the invention.

Furthermore, the inner wall of each side plate 2 is provided with a plurality of mounting posts 25 at suitable positions for receiving screws passing through corresponding track holes 251 of a slide track 26. The slide track 26 is locked to the inner wall of each side plate 2. A computer keyboard rack disclosed in U.S. Ser. No. 08/598,002 owned by the applicant of the present invention may be disposed between the slide tracks 26. In actual use, the keyboard rack may be drawn out for operation. On the contrary, due to the arrangement of the slide tracks 26, the keyboard rack together with the keyboard may be pushed into a space defined by the side plates 2.

In addition, in consideration of connection of the ring hole 121 and the peripheral products, a relay rod 3 may be inserted into the ring hole 121 such that a lower rod portion 31 at a lower portion of the relay rod 3 passes into the ring hole 121 and the curved hole 211 and be positioned therein. A rod ring 32 at a middle portion of the relay rod 3 is insertably coupled with the plate ring 12 to secure the relay rod 3 in the plate ring 12. An upper rod portion 33 at an upper portion of the relay rod 3 may be further connected to a copy holder, telephone rack or stereo rack to provide better convenience. Certainly, if such holders or racks are equipped with support shafts, the ring cap 13 may be taken down so that the support shaft of the holder or rack may be inserted into the ring hole 121 and the curved hole 211.

In order to enhance stability of connection of the top plate 1 and the side plates 2, the top plate 1 may have a plurality of hooks extending downwardly form both sides thereof. On the other hand, the side plates 2 are provided with corresponding hook holes for receiving the hooks. As such is well known in the art, it will not be described in detail herein.

In the present invention, the computer rack may be injection molded instead of bent from metal plates. Besides, at least one corner of the computer rack may be provided with a ring hole for connecting other peripheral equipment, which is not disclosed in any prior art. Furthermore, the bottom side of the top plate may be provided with a reinforcing element to enhance the rigidity and structural strength of the top plate so that it may bear greater loads. Besides, slide tracks may be mounted at the respective inner walls of the side plates for connection with a keyboard rack or the like.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved computer rack for placement on a desk surface, said improved computer rack comprising:

a top plate having a plate surface with a top side and a bottom side, at least one corner of said top side being sunken to form a plate ring with a ring hole at a center thereof for receiving a support shaft of a computer peripheral device, said bottom side being provided with a plurality of criss-cross partition ribs;

two side plates, said two side plates being arranged opposite to each other and fixedly provided at both sides of said top plate, a plate post being disposed at a front end and a rear end of each of said two side plates, each plate post having a curved hole at an upper end for matching each said ring hole, and a post leg at a lower end for contacting the desk surface, and each of said two side plates having a plurality of criss-cross plate ribs at an inner wall thereof.

2. An improved computer rack as claimed in claim 1, wherein said ring holes are each sealed with a ring cap disposed in the plate ring.

3. An improved computer rack as claimed in claim 1, wherein at least two plate grooves are provided among said partition ribs, and a reinforcing element connected to each groove for enhancing the structural strength of said top plate.

4. An improved computer rack as claimed in claim 1, wherein each said two side plates further includes a slide track for disposing a keyboard rack between the slide tracks.

5. An improved computer rack as claimed in claim 1, further comprising a relay rod, said relay rod having an upper rod portion, a middle ring portion, and a lower rod portion, said lower rod portion being inserted into said ring hole and said curved hole, said middle ring portion being inserted into said plate ring, and said upper rod portion for connection to a computer peripheral device.

6. An improved computer rack as claimed in claim 3, wherein said two side plates are each provided with a plurality of lugs corresponding to said reinforcing elements for receiving screws that are extendible through the reinforcing elements and engageable with a plurality of lock posts provided at an inner wall of said top plate.

* * * * *